United States Patent [19]

Jaedicke

[11] 4,277,057

[45] Jul. 7, 1981

[54] METHOD FOR USING A MULTIPLE INPUT BIN COLLATING MACHINE WITH A SINGLE OUTPUT HOPPER

[75] Inventor: Wilfried Jaedicke, Abenberg, Fed. Rep. of Germany

[73] Assignee: Maul Lochkartengeräte GmbH, Schwabach, Fed. Rep. of Germany

[21] Appl. No.: 98,137

[22] Filed: Nov. 28, 1979

[30] Foreign Application Priority Data

Nov. 30, 1978 [DE] Fed. Rep. of Germany ..... 2851754

[51] Int. Cl.[3] ..... B65H 39/04

[52] U.S. Cl. ..... 270/58

[58] Field of Search ..... 270/52, 54, 56, 58; 271/287–288

[56] References Cited

U.S. PATENT DOCUMENTS 4,177,981 12/1979 Maul ..... 270/58

*Primary Examiner*—Edgar S. Burr
*Assistant Examiner*—A. Heinz
*Attorney, Agent, or Firm*—Michael J. Striker

[57] ABSTRACT

A method is disclosed for collating a plurality of sets of pages from multiple copies of the pages arranged into groups, using a collating machine having plural input bins and a single output hopper. According to the method, visually distinctive X-cards are placed either on the tops of all the groups or on the bottoms of all the groups. If necessary, blank sheets may be added to form additional groups, and X-cards are likewise placed on these. After repeated distributions of the sheets between the bins and repeated feedings of the hopper, the visually distinctive X-cards will end up grouped together in the hopper. In the intermediate stages of the method, the X-cards serve as convenient guides for the proper redistributions of the hopper contents to the bins.

3 Claims, 7 Drawing Figures

I

II

III

METHOD FOR USING A MULTIPLE INPUT BIN COLLATING MACHINE WITH A SINGLE OUTPUT HOPPER

BACKGROUND OF THE INVENTION

This invention pertains to a method for utilizing a certain type of collating machine. Various types of collating machines are known. In one type, the material to be collated is placed in a single input bin and the collated copies are routed to a plurality of output hoppers in a circular order. In this type of machine, there will be, for example, twenty output hoppers and one input bin. In the event that a user wishes to collate six sets with each set containing five pages, thirty sheets of paper will be introduced into the machine's input bin, the sheets being arranged in five groups with each group containing six identical copies. The machine will be set to utilize only six of the twenty output hoppers. When the machine is operated, each of the first six copies will be routed to a corresponding one of the output hoppers, and after the last such page is routed to the last such hopper, the first copy of the next group will be routed to the first hopper and so on, until the thirty sheets which were originally placed in the input bin are distributed into six hoppers, each hopper containing exactly five sheets. Thus, with a collating machine of this sort, the sets are delivered to individual output hoppers.

However, there also exists another type of machine which utilizes a plurality of input bins and only a single output hopper. In this type of machine, the sheets to be collated are evenly distributed between all the input bins, and the machine operates to select one sheet from each bin in a predetermined sequence and to route that sheet into the input hopper. In this latter type of machine, it would be possible, for example, to place six identical copies in each of five input bins and to turn the machine on. In this latter case, the machine would automatically select a single sheet from the first bin and route it to the hopper, and would then proceed to select sheets from the second, third, fourth, and fifth bins and route them into the output hopper in order. Thus, the output bin would contain thirty sheets divided into six sets of five pages each. This sets could then be stapled together and distributed after the collation process.

In a patent application under the name of Michael Maul having Ser. No. 894,334 and filed Apr. 7, 1978, there is set forth a method for utilizing this latter type of collating machine to collate copies even when the number of pages desired in each final set does not correspond with the number of bins in the machine. This method utilizes repeated operations in which the collated stack of sheets which is routed into the hopper is redivided and re-placed into the bins as many times as is required in order to arrive at a collated stack which has the requisite number of sets, with all the pages within a given set being in order. However, when such a method is utilized, it is very difficult for an operator of the machine to determine the points at which the collated stack of paper in the hopper should be divided for replacing the contents of the collated stack into the bins. These points of division are critical, inasmuch as an error in which only one sheet is improperly re-placed in a bin will cause the entire collating process to become scrambled.

Thus, it is desirable to provide a method for utilizing this latter type of machine for such collating operations, which method would be so designed as to enable an operator to easily ascertain the proper division points for the collated stack of paper in the hopper in order to accurately re-divide the collated stack into the proper number of groups of sheets for re-introduction into the bins. Moreover, it would be desirable to provide a method which would additionally tell an operator of the machine when the collated stack appearing in the hopper is in fact properly collated, so that an unnecessary and undesirable extra division of the sheets in the collated stack is avoided.

SUMMARY OF THE INVENTION

It is thus the object of this invention to provide a method for utilizing a collating machine with plural bins and a single hopper to collate any given number of copies of any given number of sets of pages into a single stack in which the requisite number of sets are separated from each other and grouped together, and in which all the pages within each set are in order. More particularly, it is the object of this invention to provide a method by which an operator of such a machine can easily ascertain the points of division of the collated stack located in the hopper in order to accurately divide the collated stack into the proper number of bundles (herein referred to as super-groups) and to accurately re-introduce them into the bins. Finally, it is the object of this invention to provide a method in which an operator of the machine will know when the collated stack is actually properly collated, in order to prevent an unnecessary and undesirable further re-division and re-introduction of the contents of the collated stack into the bins.

This new method utilizes an X-card which is visually distinctive from the sheets which are to be collated. In this method, as will be explained in detail hereinafter, these X-card are placed either on the top of each group of identical copies of a single page or, alternatively, are placed on the bottom of that group. If the number of pages which are to be collated is not evenly divisible by the number of bins, blank sheets are also added in order to provide a number of groups into which the number of bins can be evenly divided. If such additional groups are provided, additional X-cards are also provided and are also placed on the tops or bottoms of the additional groups, as if these original groups were not blank sheets but rather sheets which were to be originally collated.

Each time the contents of the bins are re-cycled through the collating machine, the X-cards will be re-shuffled along with the sheets to be collated. Moreover, the X-cards will, instead of remaining evenly separated from each other by intervening sheets (whether such sheets are blanks or copies), will be brought together in visually distinctive groups which can be easily located by an operator. The operator of the machine may then easily identify the points at which the collated stack appearing in the hopper may be divided, and can then divide the collated stack into as many super-groups as there are bins. Moreover, at some point all the X-cards will be grouped together, and will appear at either the top of the collated stack or the bottom, depending upon whether the X-cards were initially placed at the tops of the groups or at the bottoms of the groups. Thus, when all the visually distinctive X-cards are placed together at the top of the collated stack, an operator can ascertain that the collation process is complete and can then proceed to separate the collated stack into collated sets.

It should be noted that the terms "sheets" and "cards" are not meant to imply that this method is only suitable for use with paper. Any form of document which is suitable for use in the type of collating machine herein utilized may be collated according to this method. It should also be noted that the X-cards are only visually distinctive-they have the same dimensional characteristics as the sheets which are to be collated. Additionally, the blank sheets referred to herein may indeed be additional X-cards, depending upon whether it is necessary to remove these blank sheets or whether they may merely be left together with the collated sets when the sets are to be distributed.

Finally, although this method is contemplated for use with sheets which have identical physical dimensions and differ only in their contents, it may be that collating machines of the type utilized herein may be developed to accomodate sheets of varying sizes and shapes. As will be seen hereinafter, the identicality of the sheets and X-cards used herein is not necessary for the practice of the method disclosed.

However, it must be noted that this method presupposes certain factors in order to be practicable. The first factor presupposed is the use of groups of sheets, wherein each group contains a plurality of identical copies and wherein the groups themselves are ordered in the groups in which they are to be located within a finished set. Without this ordering, the method disclosed herein will not properly collate sets.

In sum, what is disclosed herein is a method for collating copies that have already been pre-sorted into groups of like kind, by adding to each group a visually distinctive X-card and adding additional blank or dummy sheets and X-cards as necessary and then running the sheets and X-cards through a machine of the character described, which method has the consequence that the X-cards will be grouped together during successive recyclings in order to provide an operator with easily-located points at which the collated stack in the hopper may be re-divided for proper reintroduction into the bins.

DETAILED DESCRIPTION OF PREFERRED EMBODIMENTS

Figure 2:
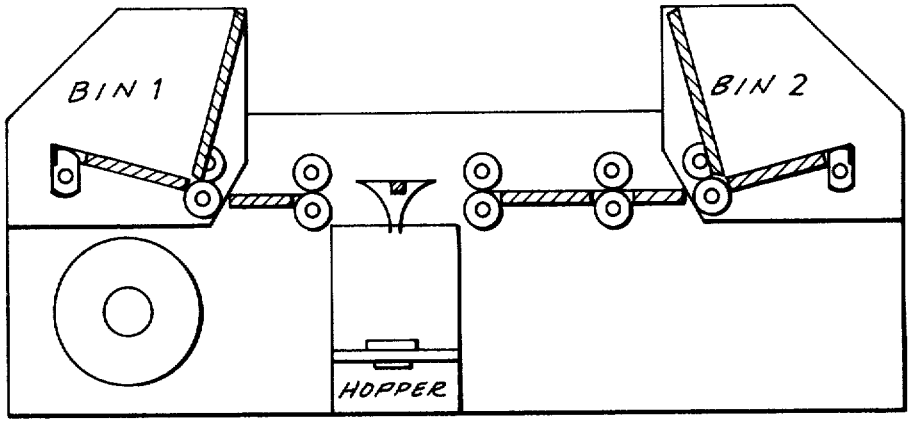
FIG. 2 shows a schematic diagram of the type of machine which is to be used with the method disclosed herein.

Referring first to FIG. 2, it may be seen that a collating machine is schematically shown, having two bins which are labelled bin 1 and bin 2 on the drawing. Moreover, this machine has a single hopper, which is so labelled on the drawing. This machine operates by first feeding a single sheet from bin 1 into the hopper, and subsequently feeding a single sheet from bin 2 into the hopper. This machine then repeats this process of alternate selection so that the sheets in the hopper form a collated stack in which any two adjacent sheets come from different bins. As will appear hereinafter, it is of critical importance to the practice of this method that both bins be filled with exactly the same number of sheets.

Figure 1:
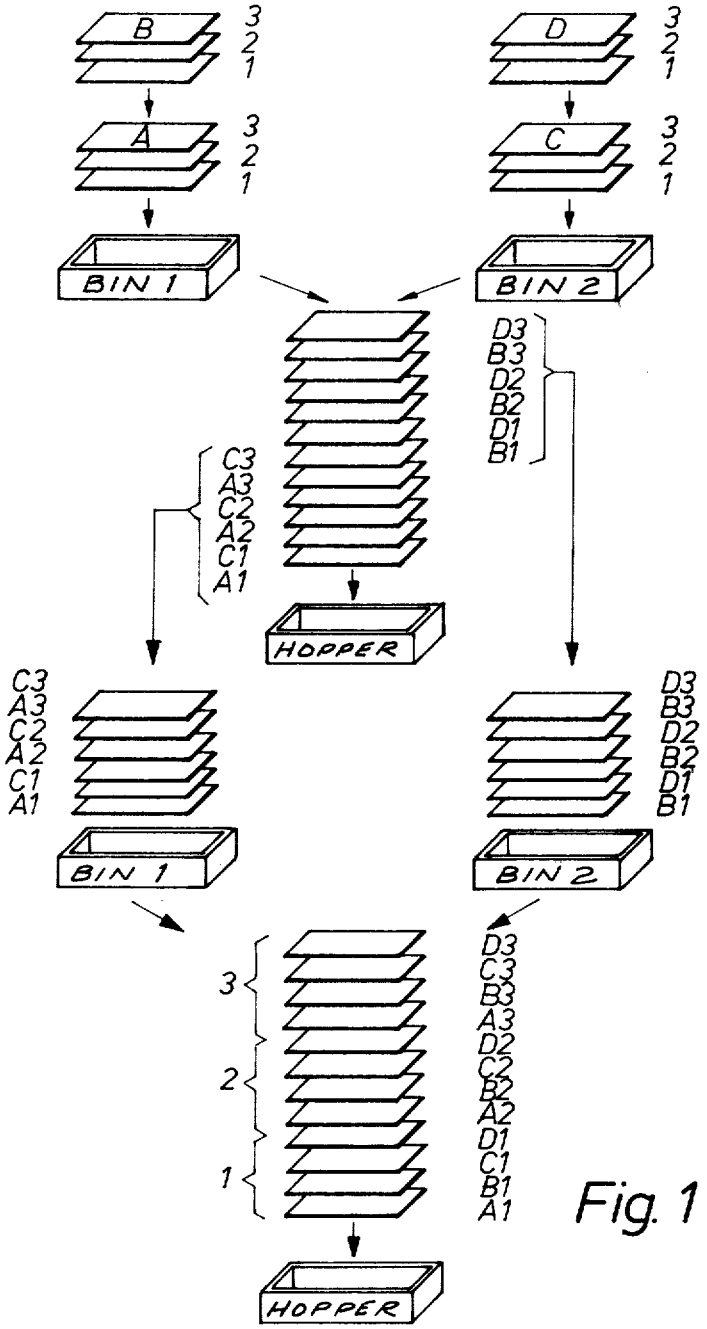
FIG. 1 is a schematic diagram showing the routing of the sheets herein collated in a machine of the type used by the inventive method disclosed herein.

Referring now to FIG. 1, it can be seen that an operator wishes to collate three sets, with each set having four pages A, B, C and D. Thus, the operator has presorted twelve sheets into four groups, each group containing three sheets which are identical copies of each other and each group thus representing three copies of each individual page. Moreover, the operator has ordered the groups into a first predetermined order, namely A, then B, then C, then D, and subsequently divided this order in half, placing group A and group B in bin one in that order, and placing group C and group D in bin two in that order. At this point it can be seen that each bin contains an equal number of sheets.

When the machine shown in FIG. 2 is operated, it can be seen that sheet A1, representing the first copy of page A, will first be routed to the hopper. Next, page C1, which represents the first copy of page C, will be routed to the hopper and placed on top of sheet A1. It can thus be seen tha a collated stack of sheets will eventually be routed to the hopper, with sheet A1 on the bottom, sheet D3 being located on the top, and all intermediate sheets being located in the hopper in the position shown in the top half of FIG. 1.

Next, the collated stack of sheets in the hopper is divided exactly in half, with the bottom half of the stack being placed in bin one and the top half of the stack being placed in bin two. When the machine is operated once again, it can be seen that the collated stack of sheets produced by this second recycling of the sheets will be divided into three sets having four pages each, with each set having the pages A, B, C and D in order. Thus, the machine of FIG. 2 has been used to collate three sets of four pages each in order.

However, when an operator desires to perform the sequence of divisions and recyclings shown in FIG. 1, it may be seen that it will be difficult for an operator to exactly divide the collated stack in the hopper into two exactly equal portions. In order to insure accuracy in such division, the operator would have to count each individual sheet in the collated stack in order to make sure that the stack was precisely divided in half. Moreover, the operator would then have to remember how many times the stack was recycled through the machine, since if the collated stack was recycled too many times, the collating of the sheets would be scrambled.

Figures 3A, 3B:
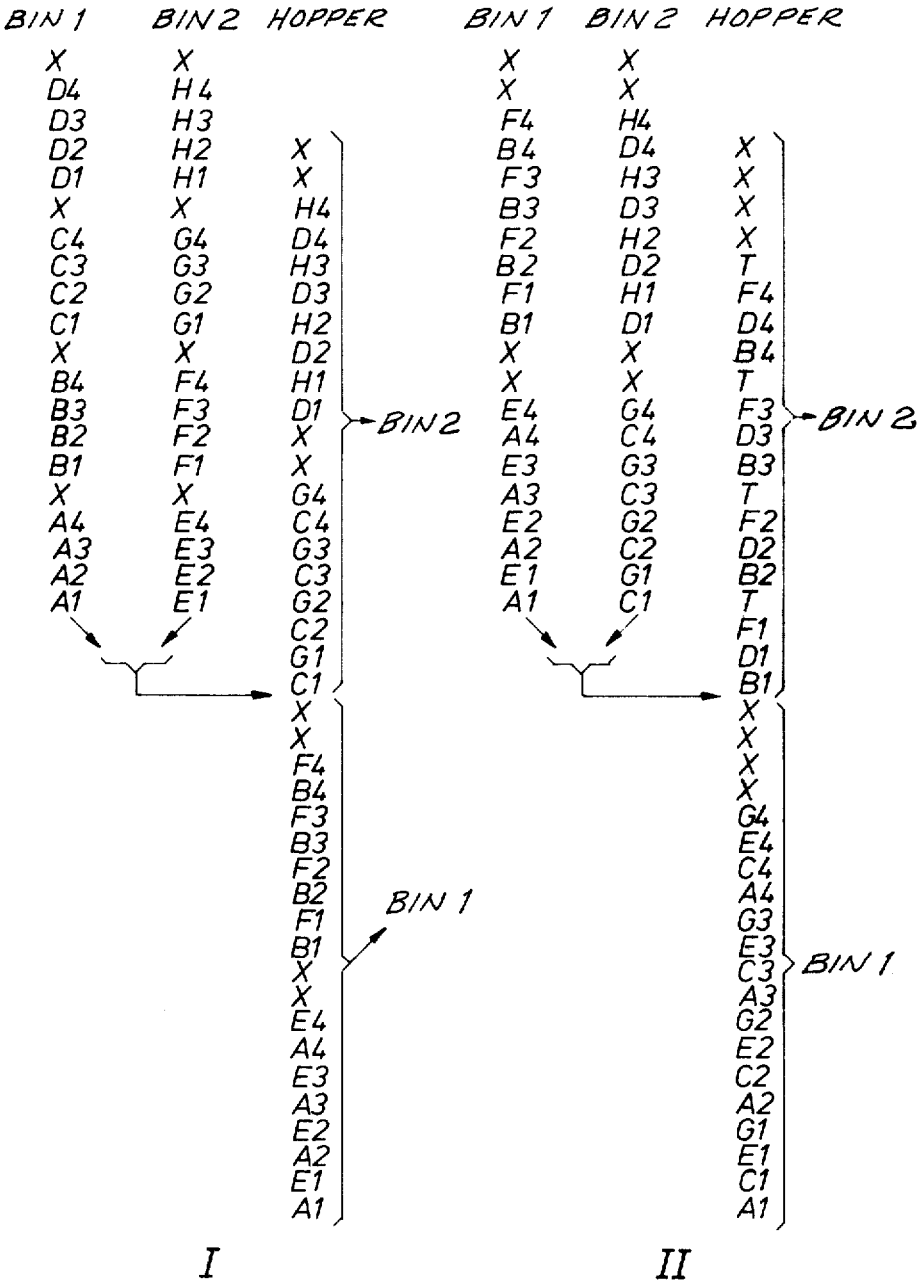
FIGS. 3*a*, 3*b* and 3*c* are schematic diagrams showing how the method disclosed herein can collate four sets of eight pages each utilizing a machine with two bins.
Figure 3C:
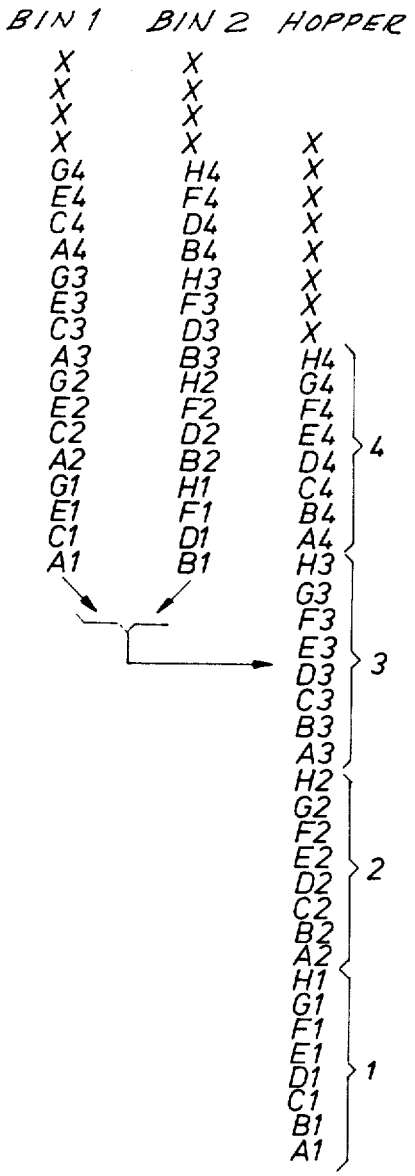

In order to enable an operator to readily ascertain where to divide the collated stack in the hopper, visually distinctive X-cards, which are denoted by the letter X in FIGS. 3*a*, 3*b*, and 3*c* are utilized. In these figures, it can be seen that an operator wishes to collate four sets, in which each set has eight pages A–H. Thus, it is necessary to initially have thirty-two sheets—representing eight pages with four copies of each page.

According to the method disclosed herein, the operator pre-sorts all these sheets into eight groups in a first predetermined order. In this case, the order is A, then B, then C, then D, then E, then F, then G, then H. Each of the eight groups thus formed has four identical sheets. Next, the operator then procures eight X-cards, and places each card on top of a corresponding group of like pages. The first four groups are then loaded into bin 1, and the next four groups are then loaded into bin 2.

After the machine shown in FIG. 2 has operated, it may be seen that all thirty-two sheets plus eight X-cards, for a total of forty sheets has been loaded into the hopper. Moreover, it can be seen that the X-cards are now reordered not into eight separate X-cards separated from adjacent cards by four sheets, but rather into four groups of two adjacent X-cards, which groups are separated from each other by eight sheets. Since the X-cards are visually distinguishable from the rest of the sheets, the operator will see that the collated stack in the hopper has four thin distinctive bands, which bands are the X-cards. It is then a simple matter for the operator to divide the collated stack into two super-groups, each containing twenty cards, and to place the bottom super-group into bin 1 and the top super-group into bin 2.

After this division and placement of the contents of the collated stack has taken place, the machine is operated once again to further re-order the sheets and X-cards. As can be seen in FIG. 3*b*, the X-cards are now reordered to form two groups of four X-cards each. Thus, an operator will now see only two distinctive bands in the collated stack, and can easily separate the collated stack into two parts, each part having twenty cards, and to place the parts back into the bins with the top part being placed into bin 2 and the bottom part being placed into bin 1.

After the machine has been operated once again, it can be seen that all the X-cards appear at the top of the collated stack. Hence, there is only one distinctive band in the collated stack. Moreover, it can also be seen that the collated stack is divided into four sets of eight pages each, with all of the pages in each set being in order. The operator can now recognize that all the sheets have been collated into sets since there is exactly one distinctive band of X-cards, which band is located at the top of the collated stack. The collated stack can then be divided into four sets, stapled, and distributed.

It is evident from FIGS. 3*a*, 3*b*, and 3*c* that the method disclosed herein would work equally effectively if all of the X-cards were placed at the bottoms of the eight groups of pages. In this latter case, the repeated divisions of the collated stack would occur in the same fashion, but the eventually fully-collated stack shown in FIG. 3*c* would have the single distinctive band located not at its top but rather at its bottom.

Thus, it may be seen that where the number of pages utilized can be evenly divided by the number of bins in the machine, it is only necessary to place an X-card on the top or the bottom of every group of identical pages, and to then stack the groups and X-cards into the bins in order. For example, if a machine is utilized which has three bins and nine pages A–I are to be collated, then the A group, the B group and the C group will be placed in bin 1, the D group, E group and F group will be placed in bin 2 and the G group, H group and I group will be placed in bin 3, after X-cards have been placed on the tops or bottoms of each group. In this example, the machine would be operated and the collated stack in the hopper would first exhibit three distinctive bands of three X-cards each, which would facilitate division of the collated stack into three separate super-groups which, after re-introduction into the three bins, would be collated into sets, with nine X-cards located at the top of the collated stack.

A slightly more difficult problem arises when the number of pages which are to be collated into sets is not evenly divisible by the number of bins used in the machine. For example, it might be that instead of collating eight pages in a two-bin machine, such as was illustrated in FIGS. 3*a*, 3*b* and 3*c*, that there were only seven pages A–G to be collated. In this case, it would have been necessary to add additional blank pages and additional X-cards to the seven groups in order to create a number of groups which was evenly divisible by two. Thus, it would have been necessary to add an additional group of pages to the seven groups to be collated in order to produce eight groups, which can be evenly divided between two bins. In this case, it would have been necessary to add four blank sheets (representing four copies multiplied by one additional group) to the sheets which are introduced into the bins, and to place an X-card on top of the group of blank sheets so as to practice this method.

It will be apparent to those skilled in the art that, in the case thus described, the method taught herein could also be used if three additional groups of four blank sheets each were added, with each additional group having an X-card located on its top. In this case, groups A–E would be placed in bin 1, and groups F and G plus the three additional groups of blank sheets would be placed in bin 2. Thus, it may be seen that if the letter P represents the number of pages which are to be collated to form a set, the letter B represents the number of bins in the machine, the letter S represents the number of sets to be collated, and the letter N represents the number of additional groups of S blank pages each which are to be added to the pages to be collated, that this method will operate properly for any N such that S quotient in which the sum of P and N is the numerator and in which B is the denominator is an integer.

Figure 4A:
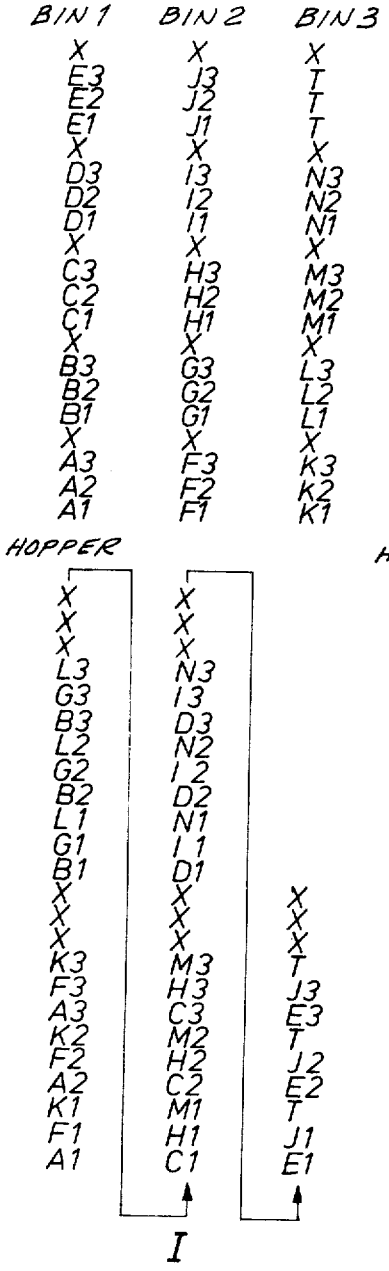
FIGS. 4*a* and 4*b* show a schematic diagram of how a second embodiment of the method disclosed herein can be used with a collating machine having five bins.
Figure 4B:
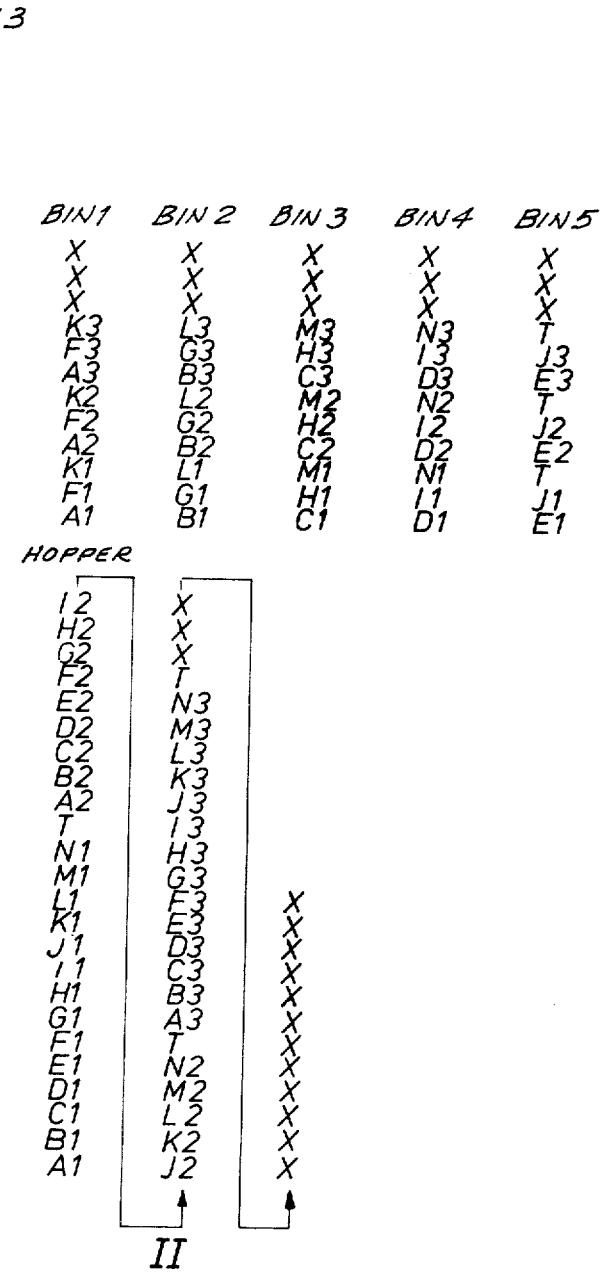

The schematic diagrams in FIGS. 4*a* and 4*b* shown a second embodiment of the method taught herein wherein the collating machine has five bins. In this embodiment, there are fourteen pages A–N which are to be collated, and each page has three copies. When this embodiment of the method is utilized, a group of three blank sheets T is assembled, and an X-card is placed on top of the blank sheets T. As before, an X-card is placed on top of each of the fourteen groups.

Thus, fifteen groups are formed, and if desired, these fifteen groups can be divided into three super-groups, which super-groups are placed in three of the five bins of the machine. Since the last two bins of the machine are unused, they play no part in the first passage of the sheets through the machine.

When the machine is operated, it can be seen that the contents of the three bins will be fed into the hopper as is shown in FIG. 4*a*. The X-cards, instead of being isolated by three adjacent sheets, pass through the machine and are regrouped into five groups of three. At this point, the collated stack is divided into five parts, each part having nine sheets and three X-cards, and each part is placed into a corresponding one of the five bins, keeping the order intact. Then, a subsequent passage of the sheets through the machine will yield the collated stack order that is shown in FIG. 4*b*, with all of the X-cards being grouped together at the top of the collated stack. As before, it makes no difference whether the X-cards are placed at the bottoms of the groups or at the tops of the groups, as long as all the X-cards are placed in a similar fashion on each group.

The reason why the method shown in FIGS. 4*a* and 4*b* is considered to be a second embodiment of the method taught herein is that not all the bins in the machine are used. For example, it would have been possible to take the fourteen groups of pages and to divide these groups into groups A–G, and groups H–N. These two parts could then have been placed in bin 1 and bin 2, ignoring all the other bins, and the collated stack thus produced divided only into two parts and re-introduced into bins 1 and 2 until the collating process was complete, as evidenced by a single distinct band of X-cards located at the top of the collated stack. Moreover, it should be noted that in this example, it would have been more economical of operating time to load groups A, B, and C into bin 1, groups D, E and F into bin 2, groups G, H and I into bin 3, groups J, K and L into bin 4 and groups M, N and the additional group of blank sheets into bin 5, all of the groups having of course been assembled together with X-cards. Had the groups been initially so arranged, the entire plurality of sheets would have been collated in one task.

It is worthy of mention that, whenever blank sheets are added to the pages in order to provide a number of groups which is divisible by the number of bins to be used, that at least some of the sets which are eventually collated will include these blank pages. In the event that it is acceptable for the sets to include such blank pages, then it is not necessary to remove them. However, if it is desired to remove these blank pages the method taught herein may be still further modified to utilize X-cards instead of blank pages, in which case the finally collated stack which includes all the sets in collated form will have a distinctive band around its top and a plurality of X-cards dispersed throughout the rest of the collated stack. In this third embodiment of the method, it should be noted that the efficacy of the method taught herein is not diminished, because the additional X-cards will always be separated from each other by regular intervals and, in the finally collated stack, none of such regularly-collated X-cards will be adjacent each other.

The detailed description provided herein is only intended for use as illustrating the concept of the invention. It is not intended to be used to limit the scope of the invention. That scope is to be determined only when reference is had to the following claims:

I claim:

1. A method for utilizing a collating machine having a plurality of infeed bins equal to B and exactly one output hopper for conveniently sorting a plurality of stacks of sheets exactly equal to B into a plurality of sets of sheets exactly equal to S wherein each of the sets of sheets contains a plurality of pages exactly equal to P arranged in a first predetermined order and wherein B, S and P are each integers at least equal to 2 and all sets are to be sorted into the output hopper in a single stack in which stack each of the sets retains the first predetermined order and the sets themselves are arranged in a second predetermined order when the machine is programmed to feed sheets from the bins into the hopper to form a collated stack with a top and a bottom in a repeated sequence, which sequence has a plurality of operations equal to B and which sequence is repeated a plurality of times equal to P and in which a single sheet is selected from a first bin and is fed into the hopper and another single sheet is selected from another bin and is fed into the hopper with such selection and feeding encompassing all the bins in a third predetermined order until exactly B sheets have been fed into the hopper, at which point the sequence is repeated a plurality of times exactly equal to P, beginning again with the first bin and maintaining the third predetermined order until all sheets in all bins have been fed into the hopper, the method comprising the following steps:

(a) providing a plurality of groups exactly equal to P of sheets, each group containing a plurality of identical pages exactly equal to S;

(b) providing a plurality of X-cards, which X-cards are easily visually distinguishable from the sheets, the plurality of the X-cards being exactly equal to P;

(c) stacking each group into an individual stack with a top and a bottom;

(d) placing each X-card on one of said top and bottom of each group so individually stacked so as to bring the X-cards and individual stacks into one-to-one correspondence;

(e) arranging all the individually stacked groups with their X-cards in the first predetermined order;

(f) computing a first quotient in which P is numerator and B is denominator;

(g) determining whether said quotient is an integer;

(h) in the event that said first quotient is non-integral, computing a number N, which, when added to P and used as numerator in a second quotient in which B is denominator, is of such a value as to produce a second quotient which is an integer;

(i) in the event that said first quotient is non-integral, providing a plurality of blank sheets, which plurality is exactly equal to N multiplied by S;

(j) in the event that said first quotient is non-integral, stacking said plurality of blank sheets into exactly N additional groups, each group having a top and a bottom and each such group containing exactly S sheets;

(k) in the event that said first quotient is non-integral, providing an additional plurality of X-cards, which additional plurality of X-cards is exactly equal to N;

(l) in the event that said first quotient is non-integral, placing each additional X-card on said one of said top and bottom of each additional group so as to bring the additional X-cards and additional groups into one-to-one correspondence;

(m) arranging any and all additional groups with their X-cards after the first predetermined order to form a series of groups;

(n) dividing the series of groups evenly into B super-groups, with each super-group containing an equal number of sheets and X-cards, while maintaining the order of the groups within the super-groups;

(o) placing each super-group into a corresponding one of the bins in the third predetermined order;

(p) operating the machine to feed all the sheets and X-cards into the hopper;

(q) determining the number of X-cards which are located on said one of the top and bottom of the collated stack;

(r) in the event that the number of X-cards which are located on said one of the top and bottom of the collated stack is equal to the sum of P and N if N was computed and P otherwise, removing the sets from the hopper; and (s) in the event that the number of X-cards which are located on said one of the top and bottom of the collated stack is unequal to the sume of P and N if N was computed and P otherwise, re-dividing the collated stack into B super-groups each containing an equal number of sheets and X-cards while maintaining any order of the sheets and re-placing the super-groups into the bins while maintaining all previous orders, and re-operating the machine to feed all the sheets and X-cards into the hopper once again; and (t) repeating the steps listed in steps (r) and (s) above as many times as are necessary until the number of X-cards which are located on said one of said top and bottom of said collated stack is equal to the sum of P and N if N was computed and P was not computed.

2. The method defined by claim 1, wherein said one of said top and bottom of each group or stack is the top.

3. The method defined by claim 1, wherein the number N is the minimum number necessary in order to make the second quotient integral.

* * * * *